US009343199B2

(12) United States Patent
Fogg

(10) Patent No.: US 9,343,199 B2
(45) Date of Patent: May 17, 2016

(54) UMBILICAL

(75) Inventor: David Fogg, Newcastle upon Tyne (GB)

(73) Assignee: TECHNIP FRANCE (FR)

( * ) Notice: Subject to any disclaimer, the term of this patent is extended or adjusted under 35 U.S.C. 154(b) by 739 days.

(21) Appl. No.: 13/498,803

(22) PCT Filed: Oct. 5, 2010

(86) PCT No.: PCT/GB2010/051664

§ 371 (c)(1),
(2), (4) Date: Jun. 11, 2012

(87) PCT Pub. No.: WO2011/045582

PCT Pub. Date: Apr. 21, 2011

(65) Prior Publication Data

US 2012/0241040 A1 Sep. 27, 2012

(30) Foreign Application Priority Data

Oct. 13, 2009 (GB) ..... 0917853.4

(51) Int. Cl.
*E21B 43/01* (2006.01)
*H01B 7/04* (2006.01)

(52) U.S. Cl.
CPC ..... *H01B 7/046* (2013.01); *E21B 43/0107* (2013.01); *Y10T 29/49826* (2015.01)

(58) Field of Classification Search
CPC ..... E21B 43/0107; H01B 7/046
USPC ..... 166/345, 346, 351, 360; 138/118, 129, 138/172; 174/47
See application file for complete search history.

(56) References Cited

U.S. PATENT DOCUMENTS

| | | | | |
|---|---|---|---|---|
| 2,463,590 | A * | 3/1949 | Arutunoff | 174/108 |
| 4,196,307 | A * | 4/1980 | Moore et al. | 174/47 |
| 5,902,958 | A * | 5/1999 | Haxton | 174/47 |
| 6,046,404 | A * | 4/2000 | Figenschou et al. | 174/47 |
| 6,146,052 | A * | 11/2000 | Jacobsen et al. | 405/169 |
| 6,283,206 | B1 * | 9/2001 | Fraser et al. | 166/242.3 |

(Continued)

FOREIGN PATENT DOCUMENTS

| | | |
|---|---|---|
| GB | 2 316 990 | 3/1998 |
| GB | 2 326 177 | 12/1998 |

(Continued)

OTHER PUBLICATIONS

International Search Report dated Dec. 27, 2010 issued in corresponding international patent application No. PCT/GB2010/051664.

(Continued)

*Primary Examiner* — Matthew R Buck
(74) *Attorney, Agent, or Firm* — Ostrolenk Faber LLP

(57) ABSTRACT

An umbilical for use in the offshore production of hydrocarbons, and in particular to a power umbilical for use in deep water applications, is described comprising a plurality of longitudinal strength members, said strength members having one or more varying characteristics along the length of the umbilical. In this way, the longitudinal strength members in the umbilical can be provided to have for example a higher or greater tensile strength where required, usually nearer to the surface of the water or topside, while having lower or less tensile strength, and usually therefore lower or less weight, where higher or greater strength is not as critical.

17 Claims, 6 Drawing Sheets

(56) References Cited

U.S. PATENT DOCUMENTS

| | | | | |
|---|---|---|---|---|
| 6,472,614 | B1 * | 10/2002 | Dupont et al. | 174/70 S |
| 6,538,198 | B1 * | 3/2003 | Wooters | 174/47 |
| 7,754,966 | B2 * | 7/2010 | Figenschou | 174/47 |
| 7,862,891 | B2 * | 1/2011 | Hanna et al. | 428/378 |
| 8,270,793 | B2 * | 9/2012 | Figenschou et al. | 385/101 |
| 8,304,651 | B2 * | 11/2012 | Figenschou et al. | 174/47 |
| 2007/0251694 | A1 * | 11/2007 | Ju et al. | 166/345 |

FOREIGN PATENT DOCUMENTS

| | | |
|---|---|---|
| JP | 53-46684 | 4/1978 |
| WO | WO 93/17176 | 9/1993 |
| WO | WO 2005/124095 | 12/2005 |
| WO | WO 2008/075964 | 6/2008 |
| WO | WO 2008/075965 | 6/2008 |
| WO | WO 2009/064559 | 5/2009 |

OTHER PUBLICATIONS

Search Report dated Feb. 25, 2010 issued in corresponding UK Application No. 0917853.4 (5 pages).

Notification Concerning Transmittal of International Preliminary Report on Patentability with a mailing date of Apr. 26, 2012, International Preliminary Report on Patentability and Written Opinion of the International Searching Authority issued in corresponding International Application No. PCT/GB2010/051664 (6 pages).

* cited by examiner

UMBILICAL

CROSS REFERENCE TO RELATED APPLICATIONS

The present application is a 35 U.S.C. §371 National Phase conversion of PCT/GB2010/051664, filed Oct. 5, 2010, which claims benefit of British Application No. 0917853.4, filed Oct. 13, 2009, the disclosure of which is incorporated herein by reference. The PCT International Application was published in the English language.

BACKGROUND OF THE INVENTION

The present invention relates to an umbilical for use in the offshore production of hydrocarbons, and in particular to a power umbilical for use in deep water applications.

An umbilical consists of a group of one or more types of elongated or longitudinal active umbilical elements, such as electrical cables, optical fibre cables, steel tubes and/or hoses, cabled together for flexibility, over-sheathed and, when applicable, armoured for mechanical strength. Umbilicals are typically used for transmitting power, signals and fluids (for example for fluid injection, hydraulic power, gas release, etc.) to and from a subsea installation.

The umbilical cross-section is generally circular, the elongated elements being wound together either in a helical or in a S/Z pattern. In order to fill the interstitial voids between the various umbilical elements and obtain the desired configuration, filler components may be included within the voids.

ISO 13628-5 "Specification for Subsea Umbilicals" provides standards for the design and manufacture of such umbilicals.

Subsea umbilicals are installed at increasing water depths, commonly deeper than 2000 m. Such umbilicals have to be able to withstand severe loading conditions during their installation and their service life.

The main load bearing components in charge of withstanding the axial loads due to the weight (tension) and to the movements (bending stresses) of the umbilical are steels tubes (see for example U.S. Pat. No. 6,472,614, WO93/17176, GB2316990), steel rods (U.S. Pat. No. 6,472,614), composite rods (WO2005/124095, US2007/0251694), steel ropes (GB2326177, WO2005/124095), or tensile armour layers (see FIG. 1 of U.S. Pat. No. 6,472,614).

The other elements such as the electrical and optical cables, the thermoplastic hoses, the polymeric external sheath and the polymeric filler components, do not contribute significantly to the tensile strength of the umbilical.

The load bearing components of most umbilicals are made of steel, which adds strength but also weight to the structure. As the water depth increases, the suspended weight also increases (for example in a riser configuration) until a limit is reached at which the umbilical is not able to support its own suspended weight. This limit depends on the structure and on the dynamic conditions at the (water) surface or 'topside'. This limit is around 3000 m for steel reinforced dynamic power umbilicals (i.e. umbilical risers comprising large and heavy electrical power cables with copper conductors).

However, it is desired to create power umbilicals for ultra deep water (such as depth (D)>3000 m). Such umbilicals comprise very heavy copper conductor cables and must be strongly reinforced to be able to withstand their beyond-normal suspended weight and the dynamic installation and operating loads. An easy solution would be to reinforce such umbilicals with further steel load bearing strength members, such as the rods, wires, tubes or ropes described above. However, due to the specific gravity of steel, this solution now also adds a significant weight to the umbilical. In static conditions, the water depth limit of this design is around D=3200 m, where the maximum tensile stress in the copper conductors of the power cables (being weak point of the structure) reaches its yield point (at the topside area close to the surface). However, in any dynamic conditions, this depth limit is naturally lower because of the fatigue phenomenon. Depending on the waves, on the floating production unit movements, and on the kind of bend stiffener which is used, the limit of this design in dynamic conditions is between 2700 m and 3000 m.

Furthermore, such steel reinforced umbilicals are very very heavy and require evermore powerful and expensive installation vessels.

A suggested solution to this problem consists in using composite material strength members shown by WO2005/124095 and US2007/0251694. However, such umbilicals are difficult to manufacture and so are very expensive.

GB2326177A discloses a deep water umbilical comprising a large central steel cable 4 surrounded by helically wound fillers and peripheral steel tubes 2". In the lower section, this assembly is replaced by a large steel tube 5. However, the cable-tube transition is very complex and difficult to manufacture. The helical peripheral tubes 2" must also be connected to the large central tube 5 through a manifold which is also used for transmitting the tensile load to the large central cable 4.

SUMMARY OF THE INVENTION

An object of the present invention is to overcome one or more of the above limitations and to provide an umbilical which can be used at greater water depths (up to 3000 m and more) and/or under greater or more severe dynamic loading.

According to one aspect of the present invention, there is provided an umbilical comprising a plurality of longitudinal strength members, said strength members having one or more varying characteristics along the length of the umbilical.

In this way, the longitudinal strength members in the umbilical can be provided to have one or more specific characteristics, such as higher or greater tensile strength, where required, usually nearer to the surface of the water or topside, whilst having one or more different characteristics, such as lower or less tensile strength, and usually therefore lower or less weight, where properties such as strength are not as critical.

The plurality of strength members provide the load bearing of the umbilical in use, and are generally formed as windings in the umbilical along with the other umbilical elements, generally not being the core of the umbilical.

The term "varying characteristic" as used herein relates to a change, variation or other difference in a mechanical and/or physical property of the longitudinal strength members in the longitudinal or elongate direction of the strength members, which extend at least partly, optionally wholly or substantially, along the length of the umbilical. Such a change can be a change in the property of the characteristic(s) itself, or a change in the measurement or value of at least one characteristic at at least one cross-sectional point along the length of the strength member compared to a measurement or value of the same characteristic(s) at at least one other cross-sectional point of the strength member.

The characteristic(s) which vary along the length of the elongate strength members may be one or more from the group comprising:

tensile strength, specific gravity, strength to weight ratio,
fatigue resistance,
flexibility,
temperature resistance,
corrosion resistance,
yield strength,
Young's modulus,
axial stiffness, and
stress.

The term "tensile strength" as used herein is defined as the ultimate tensile strength of a material or component, which is maximum tensile force that the material or component can withstand without breaking.

The term "specific gravity" as used herein relates to the ratio of the mass of a given volume of the material or component to the mass of an equal volume of water. This may or may not relate to a change in any strength characteristic, for example, transition between a steel rod and a composite light rod having almost the same strength as steel.

The term "strength to weight ratio" as used herein relates to strength being based on tensile strength.

The term "fatigue resistance" as used herein relates to the resistance to repeated application of a cycle of stress to a material or component which can involve one or more factors including amplitude, average severity, rate of cyclic stress and temperature effect, generally to the upper limit of a range of stress that the material or component can withstand indefinitely. The term "flexibility" as used herein relates to bending stiffness.

The term "temperature resistance" as used herein relates to the ability of the strength member to withstand changes in its temperature environment. For example, they can be significantly higher temperatures near to the topside of a riser umbilical inside a hot I-tube or J-tube, so that it may be desired or necessary to avoid the use of materials such as zylon rope close to the topside because of such higher temperatures.

The term "corrosion resistance" as used herein relates to the resistance to decomposition of the strength member following interaction with water. The term "corrosion" is applied to both metallic and non metallic materials. The hydrolysis ageing of polymeric materials is considered as a corrosion phenomenon. As an example, strength members made of high strength polymeric materials such as zylon may have lower corrosion resistance than steel.

The term "yield strength" as used herein relates to the force of stress that can be applied before plastic deformation of a material takes place under constant or reduced load.

The term "Young's modulus" as used herein relates to the modulus of elasticity applicable to the stretching of an elongate item, generally based on the ratio of tensile stress per tensile strain. It can also be known as stretch or elongation modulus. Young's modulus can affect the axial stiffness of the strength members.

The term "axial stiffness" as used herein relates to the tensile load to achieve 100% strain (in an ideal elastic material). For a homogeneous elastic rod, the axial stiffness is equal to the product of the cross-sectional area and the Young's modulus.

The term "stress" as used herein can relate to ultimate tensile stress and/or yield stress, being the force per unit area acting on a material and tending to change dimensions, generally being the ratio of force per area resisting the force.

Table 1 hereunder provides examples of measurements for various characteristics for various materials used to form elongate strength members in umbilicals and known in the art, by are provided as examples of measurements only.

TABLE 1

| | Core Material | | | | |
|---|---|---|---|---|---|
| | Young's modulus [GPa] | Ultimate Tensile Stress [MPa] | Density [kg/m$^3$] | Strength [kN] | Axial Stiffness [kN] |
| 20 mm OD polymeric filler | 0.7 | 20 | 970 | 6 | 220 |
| 20 mm OD over sheathed steel rope = 15.6 mm OD steel rope core covered by a 2.2 mm thick polyethylene sheath. | 210 | 1460 | 7850 | 220 | 31305 |
| 20 mm OD over sheathed fibre rope = 14.5 mm OD high strength fibre rope core covered by a 2.75 mm thick polyethylene sheath. | 216 | 2640 | 1800 | 282 | 22932 |

The present invention uses the known measurements of materials used in forming umbilicals to effect a change in at least one characteristic along the length of the varying elongate strength members, and so effect at least one change in the characteristics of the umbilical along its length. Such changes are generally related to strength, but include other changes such as flexibility and bending stresses, fatigue resistance, resistance to local environment and the like, where it is desired or necessary to have an umbilical with one or more characteristics at a location(s) or along a portion(s) of its length different to characteristics at another location(s) or another portion of its length(s).

The variation in a characteristic(s) along the strength members may comprise one change or a multiple of changes. Each such change may be defined by a transition zone over which the characteristic(s) varies from one end or side of the transition zone to the other.

One such change, or a number of a plurality of such changes, or all such changes, may be step, sharp or distinct changes in the characteristic(s), or involve a variation in the characteristic(s) over a section of the strength member. The present invention is not limited by the number of changes in characteristic(s) along the length of the strength member, or by the number and type of changes or transition zones between sections of the length member having different characteristics.

The variation(s) in characteristic(s) of a strength member may occur at any point(s), stage(s) or location(s) along the length of the strength member. Thus, the present invention is not limited by the extent of different lengths of the strength member having different characteristic(s).

Each extent, length or section of a strength member may have a regular or constant characteristic(s), or one or more varying characteristics in its own right.

Thus, according to one embodiment of the present invention, there is provided an umbilical comprising a plurality of longitudinal strength members comprising sequentially at least a first section having a first characteristic(s) extending from one end of the umbilical, a transition zone, and a second section having a second and different characteristic to the first section, preferably extending to the other end of the umbilical.

The or each transition zone may provide a sudden change in characteristic(s) along the longitudinal direction of the strength member. Optionally, the or each transition zone provides a section of the strength member having an intermediate and/or greater characteristic(s) than at least one of the characteristic(s) on either side of the transition zone.

According to another embodiment of the present invention, a transition zone comprises a combination of the characteristics of the sections of the strength member on either side of the transition zone, optionally with reinforcement therewith, therein and/or therearound.

The or each transition zone may also comprise a join or joint between the sections of the strength member on either side of the transition zone, in particular to provide a longitudinal strength member having a continuous length being wholly or substantially the length of the umbilical.

The strength members can have a varying characteristics along their length by being formed of different materials along their length to create sections of different characteristic values or measurements, such as tensile strength, hence varying the value or measurement of the or each characteristic(s) along the overall length of the strength member.

Such longitudinal sections may be formed of any one of or any combination of suitable structures and materials, including metallic rods (for example made from one or more of steel, titanium, high strength aluminium and the like), composite rods (such as one or a combination of carbon/epoxy, carbon/peek, carbon/PPS, glass fibre/epoxy), metallic ropes (formed from similar materials to the metallic rods), composite ropes (again formed from materials similar to the composite rods, especially having a fibre or fibrous—nature), high strength organic fibre ropes (such as one or a combination of aramid, high modulus polyethylene, aromatic polyester, etc), metallic tubes and composite tubes.

Each section of the strength members of the present invention may comprise any and all combinations of such rods, tubes, ropes, optionally being a combination of same. For example, a longitudinal strength member of the present invention may be a metallic or composite rope or rod oversheathed by a polymeric tube (being a small sheath extruded around the rope or the rod), or a composite rod or rope protected by a thin-walled stainless steel tube. The invention is not limited by the possible combinations both longitudinally and transversely of these materials.

Thus, according to one particular embodiment of the present invention, the strength members comprise a plurality of different sections, said sections comprising at least two of the group comprising: steel rope, steel rod, polymeric filler, high strength fibre rope, composite rod, and composite rope.

The term "composite rope" as used herein relates to an assembly of composite strands, each strand being a composite material such that each stand comprises high strength fibres embedded in a matrix, for example unidirectional carbon fibres embedded in an epoxy resin.

The term "high strength organic fibre rope" as used herein relates to an assembly of high strength organic fibres without any matrix material, for example an assembly of Kevlar (aramid) fibres twisted together.

The longitudinal strength members for use in the present invention include the following combinations:

1. Steel rod to polymer filler
2. Steel rod to composite rod
3. Steel rod to high strength fibre rope
4. Steel rope to polymer filler
5. Steel rope to composite rod
6. Steel rope to high strength fibre rope
7. Composite rod to polymer filler
8. High strength fibre rope to polymer filler
9. Change grade of steel tube
10. Change grade of steel rod According to one embodiment of the present invention, at least one strength member comprises a steel rope section and a polymeric filler section.

According to one embodiment of the present invention, at least one strength member comprises a steel rope section and a composite rod section.

According to one embodiment of the present invention, at least one strength member comprises a steel rope section and a high strength fibre rope section.

According to one embodiment of the present invention, at least one strength member comprises a composite rod section and a polymer filler section.

According to one embodiment of the present invention, at least one strength member comprises a high strength fibre rope section and a polymeric filler section.

Combination no. 9 as described above could for example relate to having a change of steel grade from a hyper duplex in the top side area, then super duplex in mid water, and eventually duplex or lean duplex close to the sea floor.

According to another embodiment of the present invention, the umbilical has a wholly or substantially constant outer diameter along its length. In this way, the umbilical has a constant external dimension.

The constant external dimension of the umbilical can be achieved in a number of ways. For example, each of the longitudinal strength members, or at least their combination, could comprise a wholly or substantially constant outer diameter along its or their length. Longitudinal strength members having a wholly or substantially constant outer diameter provide for constant and regular handling during the manufacture of the umbilical, as well as constant and regular handling of the installation of the umbilical. Preferably, where the strength members are formed from a plurality of different sections, each section provides a constant outer diameter, including the or each transition zone thereinbetween.

Alternatively, the longitudinal strength members could extend for a certain portion of the umbilical, and their continuing position in the umbilical is occupied by one or more other or separate longitudinal strength members, generally having a different characteristic(s), and/or one or more other umbilical elements such as fillers, whose purpose is to fill the umbilical to the same extent and so provide a constant outer diameter.

Thus, according to another embodiment of the present invention, there is provided an umbilical comprising sequentially at least a plurality of elongate strength members having a first characteristic(s) extending from one end of the umbilical and terminated mid-length along the length of the umbilical, a transition zone comprising a gap, and a plurality of aligned elongate members having a different characteristic(s) to the elongate strength members, preferably extending to the other end of the umbilical.

According to another embodiment of the present invention, the or each varying strength member is wound helically or in a S/Z pattern along the umbilical. Where the strength member has a constant outer diameter as discussed hereinabove, this maintains ease of manufacture and continuity in the helical or S/Z pattern.

More preferably, the or each strength member has a constant or S/Z pattern winding along the umbilical, in particular a constant pitch or turn or wind, which allows use of the same spiralling equipment or machine to wind the whole length of the longitudinal strength member along the length of the umbilical.

Preferably, the or each change in characteristic(s), such as at the or each transition zone, does not increase, or increase beyond a de minimus extent, the outer diameter of the longitudinal strength member, such that manufacture of the umbilical can be continued without having to stop the process in because of a change or transition zone of the longitudinal strength members.

Generally, the present invention involves providing an umbilical having one end with a higher measurement of a characteristic(s) than its other end. For example, the topside or surface end connection of umbilicals such as dynamic risers, which generally involve a combination of high tension and bending which can lead to rapid fatigue damage, can be provided with a higher tensile strength based on the present invention, to increase the strength and fatigue resistance of that part or end of the umbilical, without increasing the overall weight and cost of the remaining length.

Preferably, the present invention avoids mid-water terminations (such as umbilical connectors or end fittings), to maintain ease of regular manufacture, and ease of regular installation of such umbilicals.

With the embodiment of having additional strength provided to the topside or surface end of umbilicals provided as risers, the present invention can provide an umbilical for use at a depth of greater than 2000 m, preferably going to 3000 m and beyond.

The umbilical of the present invention may further comprise one or more non-varying longitudinal strength members. A minimum characteristic such as tensile strength may be required along all parts of the umbilical, with the present invention providing the ability to increase the characteristic(s) in one or more parts, in particular those parts of the umbilical which may be subject to the greatest tension and/or bending.

According to a second aspect of the present invention, there is provided a method of manufacturing an umbilical comprising a plurality of longitudinal strength members having one or more varying characteristics along the length of the umbilical, the method comprising at least the step of forming a number of longitudinal strength members as part of the umbilical, in particular in a helical or S/Z pattern, more particularly at a constant winding.

The changes of characteristic(s) or transition zones between different sections of a longitudinal strength member can be provided according to a number of methods, some depending upon the nature of the different sections and/or the required characteristic(s) of the transition zone. Various methods are described hereinafter, and an umbilical of the present invention may involve one or more such processes and methods in its manufacture.

The present invention encompasses all combinations of various embodiments or aspects of the invention described herein. It is understood that any and all embodiments of the present invention may be taken in conjunction with any other embodiment to describe additional embodiments of the present invention. Furthermore, any elements of an embodiment may be combined with any and all other elements from any of the embodiments to describe additional embodiments.

BRIEF DESCRIPTION OF THE DRAWINGS

Embodiments of the present invention will now be described by way of example only, and with reference to the accompanying drawings in which.

DESCRIPTION OF PREFERRED EMBODIMENTS

Figure 1:
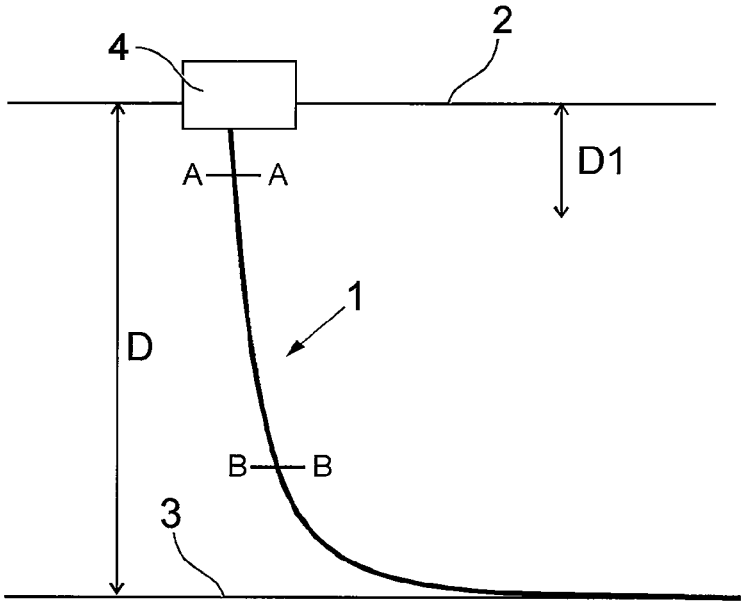
FIG. 1 is a schematic diagram of a first umbilical according to an embodiment of the present invention in a subsea catenary configuration.

Referring to the drawings, FIG. 1 shows a schematic diagram of a first umbilical 1 in catenary configuration between a floating production unit 4 at a sea surface 2, or commonly at the 'topside', and a sea floor 3 or sea bed, with a depth D therebetween.

As is known in the art, the highest tensile and bending stresses are in the top section in the umbilical 1 as it approaches the floating production unit 4, shown in FIG. 1 by the section D1 of depth D. Traditionally, where the depth D is significant (such as >2000 m), load bearing members such as steel ropes are provided along the whole length of the umbilical, generally to maintain ease of regular and constant manufacture.

However, whilst such load bearing members assist the tensile and bending stresses in the section D1, they become less useful, and therefor disadvantageous in terms of weight and cost, as the umbilical 1 continues towards the sea floor 3. The longer the umbilical, the greater the disadvantages are.

Furthermore, where the depth D is greater, certainly beyond 2000 m and even 3000 m and beyond, the weight of the heavy copper for the conducting cables further increases the need for stronger reinforcement at or near the floating production unit 4 in the region D1, to withstand the increasing suspended weight and the dynamic installation and operating loads.

Figure 2:
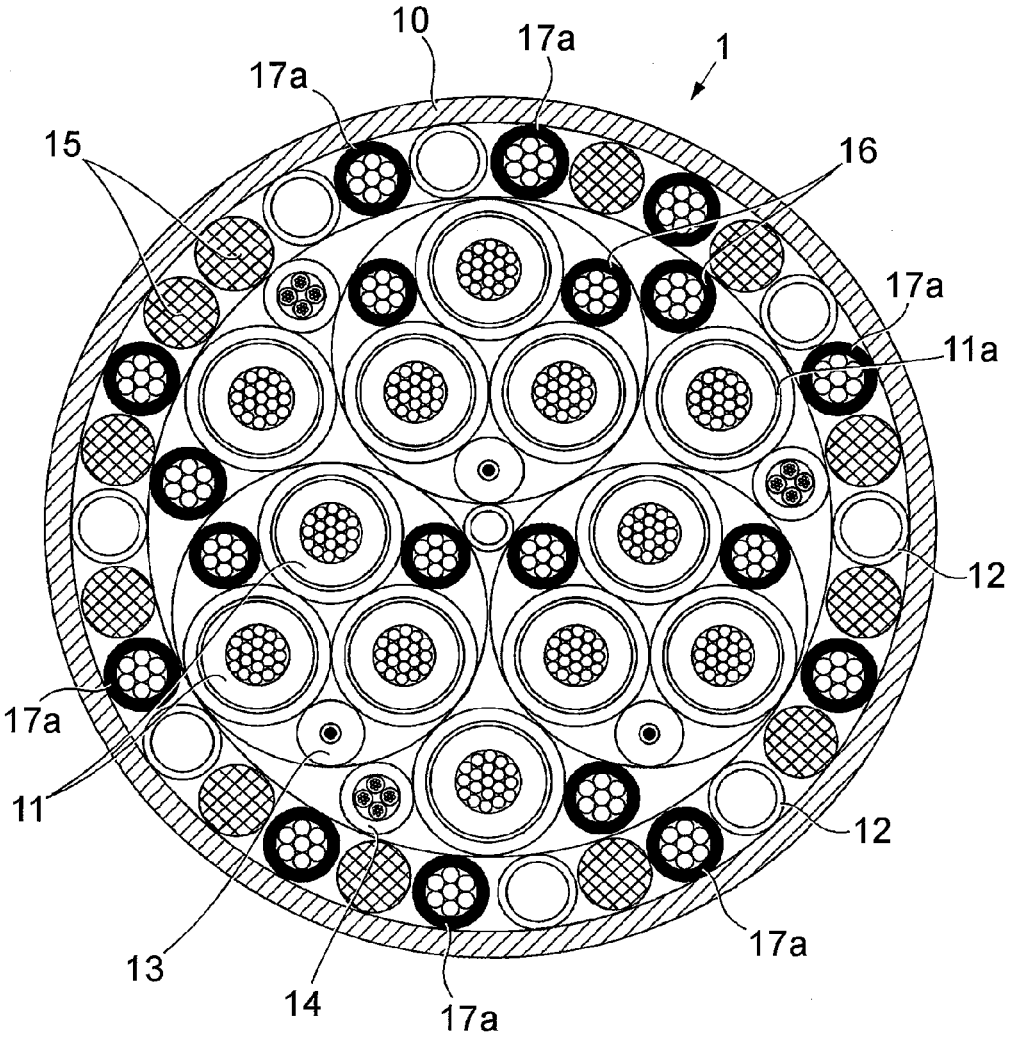
FIG. 2 is a cross sectional view of the umbilical of FIG. 1 along line AA.

FIG. 2 shows a cross-sectional view of the umbilical 1 of FIG. 1 along line AA. In the example of a power riser umbilical, the umbilical 1 comprises three large power conductors, each having three electrical power cables 11 therein, which, with three other separated power cables 11*a*, makes twelve power cables in all in FIG. 2. In addition, there are nine tubes 12, three optical fibre cables 13 and three electrical signal cables 14.

Both within the power conductors mentioned above, and in the surrounding circumferential sections, are a number of constant steel rope strength members 16, comprising a number of steel strands covered by an extruded polymeric sheath for corrosion and wear protection. These constant strength members 16 extend wholly or substantially the length of the umbilical 1.

In addition, there are a number of polymeric fillers 15 in the umbilical 1 shown in FIG. 2, which again are wholly or substantially constant along the length of the umbilical 1.

FIG. 2 also includes a number of longitudinal strength members having a varying characteristic being tensile strength along their length, and so along the length of the umbilical 1, according to one embodiment of the present invention.

In the cross-section shown in FIG. 2, the longitudinal strength members comprise a steel rope section 17*a* being the same in cross section as the constant steel rope strength members 16. This provides nineteen steel rope sections at the position of line AA in FIG. 1 within the depth section D1.

Figure 3:
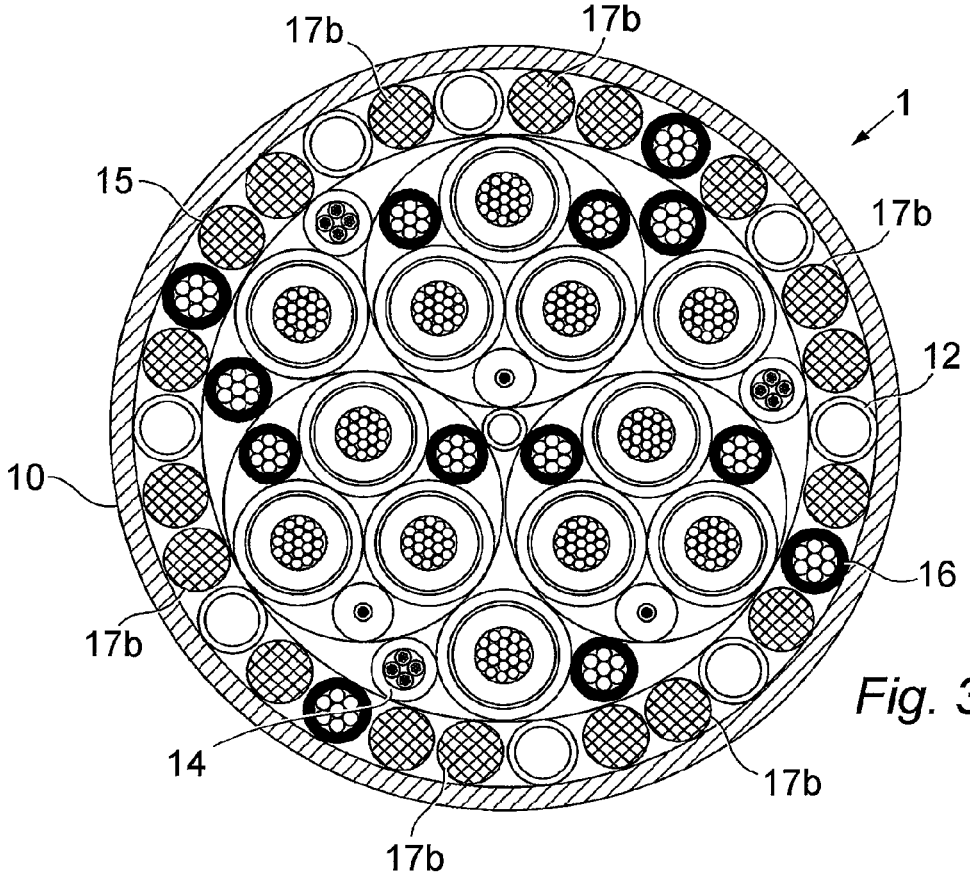
FIG. 3 is a cross sectional view of the umbilical of FIG. 1 along line BB.

FIG. 3 shows the umbilical 1 at a cross-sectional view along line BB in FIG. 1, i.e. beyond the depth section D1. FIG. 3 shows the continuance of the electrical power cables 11, tubes 12, optical fibre cables 13, electrical signal cables 14, polymeric fillers 15, and the non-varying strength members 16. However, FIG. 3 shows that the six longitudinal strength members creating the present invention in the umbilical 1 (being at line AA steel rope 17*a*), are now formed of polymeric filler 17*b*.

Thus, the umbilical 1 at line BB now has only thirteen steel rope strength members 16. The change of the longitudinal strength members from having steel rope sections 17*a* to polymeric fillers sections 17*b* provide said strength members with a varying tensile strength along their length.

In a first alternative embodiment, the six steel rope sections 17*a* of the longitudinal strength members have a varying tensile strength shown in FIG. 2 are replaced with steel rod sections which then change to polymeric filler sections as shown in FIG. 3.

For deep water applications (for example where D>2000 m), D1 is preferably comprised between 200 m and 700 m, more preferably between 400 m and 600 m, more preferably around 500 m.

Figure 4:
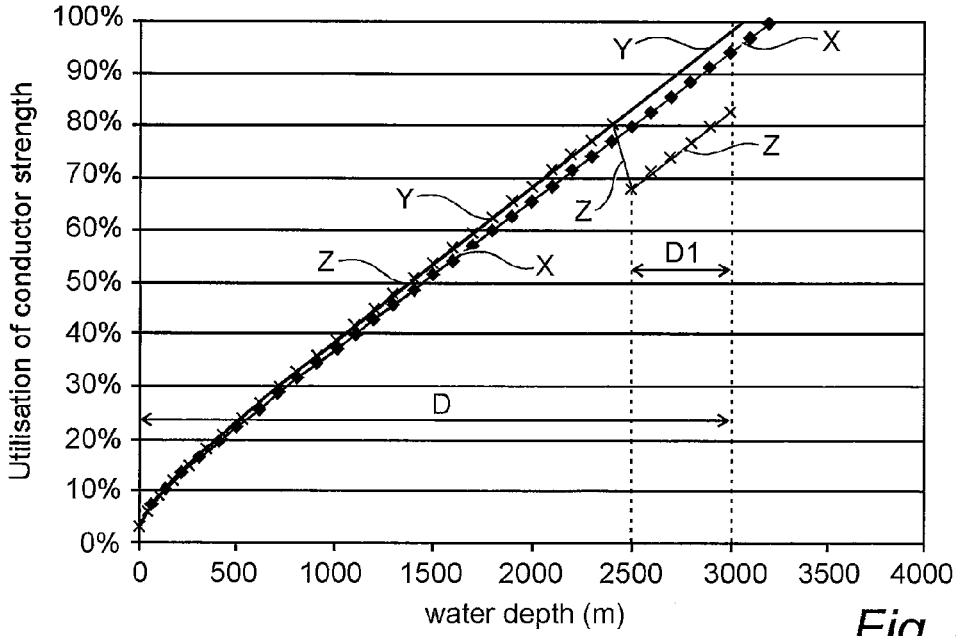
FIG. 4 is a graph of utilisation of conductor strength versus water depth showing conductor tensile stress close to a water surface depending upon umbilical depth.

FIG. 4 shows a graph of the utilisation of conductor strength against water depth (D) in meters for a typical umbilical, leading to the yield stress limit of copper, being the component of the electrical power cables in the umbilical. Copper power cables are generally the biggest cables of conventional power umbilicals such as riser umbilical shown in FIGS. 1-3.

FIG. 4 shows the maximum tensile strength in the copper conductors of the power cables versus the water depth D for three different designs, shown as lines X, Y and Z. The maximum tensile stress was measured close to the sea surface, such as the topside 2 in FIG. 1.

Line X corresponds to the change in stress near the surface with increasing depth D (and therefore length of the umbilical) based on a non-changing or constant load bearing or strength member design having nineteen steel ropes. That is, equivalent to an umbilical having the cross section shown in FIG. 2 along its entire length. It shows that such an umbilical has sufficient strength to extend just beyond a water depth of 3000 m, but it requires nineteen continuous steel rope strength members along its entire length to achieve this, with attended cost and installation complexities. Moreover, whilst this design of umbilical theoretically allows installation up to 3200 m, at 3000 m, the copper conductors are already stressed to 95% of their stress yield, which leaves little margin of error for any dynamic stresses.

Line Y corresponds to another constant umbilical design, having thirteen constant steel rope strength members along its length; that is being equivalent to an umbilical as shown in FIG. 3 without change along its length. Thirteen continuous steel rope strength members would again be sufficient to theoretically allow installation of such an umbilical design at 3000 m, but the copper conductors are now stressed so close to their yield stress limit, they would not be able to withstand any significant and/or long term dynamic loadings. Installation of such an umbilical design at 3000 m would therefore require static conditions, which cannot be guaranteed in any water-borne situation.

Line Z is based on an umbilical comprising a plurality of longitudinal strength members, said strength members having variable tensile strength along their length in accordance with the embodiment of the present invention and as shown in the combination of FIGS. 2 and 3, i.e. wherein six longitudinal strength members comprise a first section 17*a* extending from the top side or floating production unit 4 with steel rope, followed by a second section 17*b* extending to the sea floor 3 comprising a polymeric filler section.

Line Z shows that by the introduction of the steel rope section 17*a* for the depth section D1, there is a dramatic reduction in the stress of the copper conductors, such that an umbilical based on this design having a length of 3000 m results in the copper conductors only reaching approximately 82% of their yield stress limit, thus providing a large remaining strength margin, and allowing such umbilical designs to be used in harsh dynamic conditions and/or increasing their fatigue service life.

Meanwhile, the umbilical design used for line Z only requires a small section of additional steel ropes, leading to minimal effect on the overall weight of the umbilical, such as less than 5% additional weight compared to the umbilical design of line Y.

Figure 5:
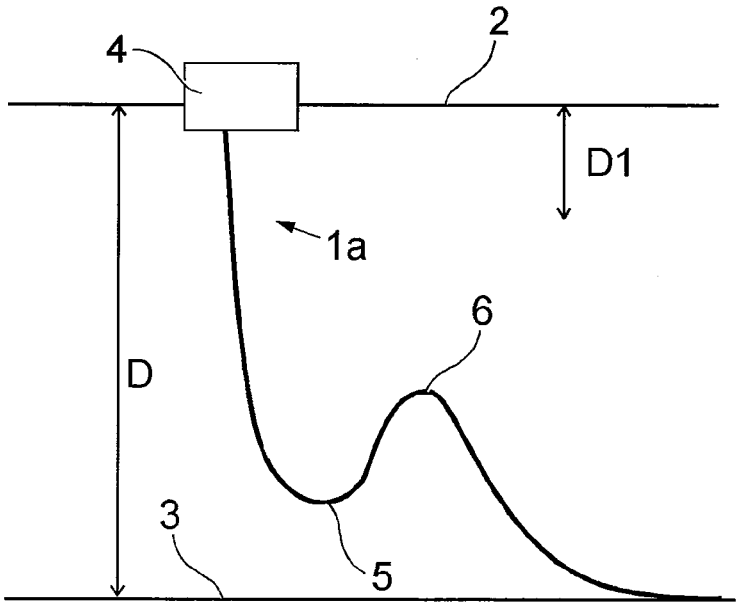
FIG. 5 is a schematic diagram of a second umbilical in a second subsea catenary configuration.

FIG. 5 shows a schematic diagram of a second umbilical 1*a* in a second subsea catenary configuration having a wave configuration, generally with a first bottom u-section 5 and a following n-section 6 between the floating production unit 4 and the sea floor 3. To achieve the wave configuration, ballast can be added at discrete locations along the umbilical 1*a*, such as for example in the area of the bottom section 5, so as to deliberately create the wave configuration.

By using longitudinal strength members with varying characteristics as described herein along the length of an umbilical, this can provide longitudinal strength members with varying weight and/or density, which can create sections of the umbilical 1*a* having difference floating depths, thus inherently providing a wave configuration by the location of one or more heavier sections at the area of the bottom section 5, optionally additionally one or more lighter sections in the section 6.

Such a local ballast solution increases the stability of 'light' risers such as composite reinforced umbilicals and/or umbilicals comprising aluminium power cables (instead of copper power cables). This could replace the conventional use of clamp weights, making installation of such umbilicals easier, and with an attendant cost reduction.

Figure 6:
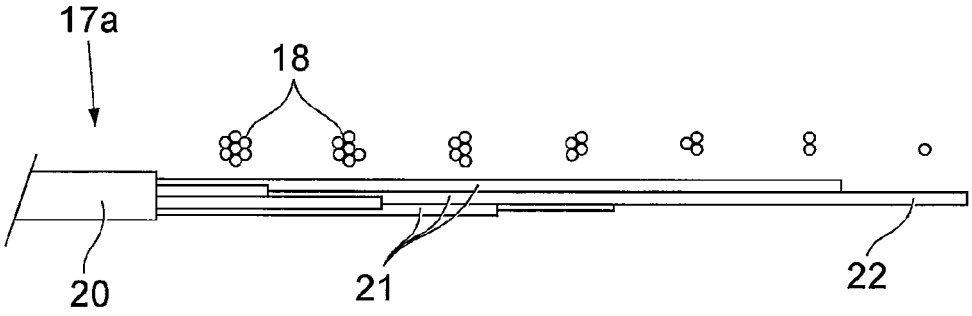
FIGS. 6, 7 and 8 are three cross-sectional drawings showing steps for joining of a steel rope to a polymeric filler.
Figure 7:
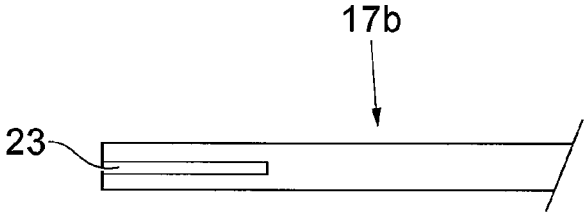
Figure 8:
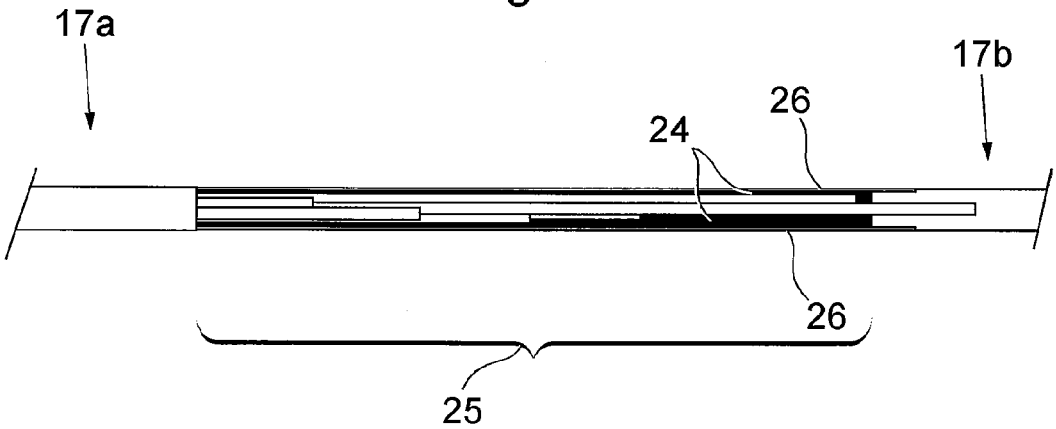

FIGS. 6-8 show three steps in a first method of providing a longitudinal strength member having a varying characteristics such as tensile strength along its length, and preferably having a constant outer diameter between two sections comprising different materials.

FIGS. 6-8 show an embodiment of the process of forming a transition zone in a longitudinal strength member for use with the present invention between a steel rope section 17*a* and a polymeric filler section 17*b*, which strength member can be used in the umbilical 1 shown in FIGS. 2 and 3.

FIG. 6 shows the end of a steel rope strength member comprising a core of seven steel ropes, surrounded by a polymer sheath 20. As shown in FIG. 6, the polymer sheath 20 is cut back from the end of the strength member to leave a remaining sheath-covered section 17*a*. Individual steel ropes 18 of the strength member are then cut at different lengths leaving a central rope 22 as the longest, and a number of differing lengths other steel ropes 21.

FIG. 7 shows the end of a polymeric filler strength member 17*b* having a hole 23 drilled along its central axis. The diameter of the hole 23 is slightly larger than the diameter of the central rope 22 of FIG. 6.

FIG. 8 shows the conjoining or assembly of the steel rope section 17*a* of FIG. 6 and the polymeric filler section 17*b* of FIG. 7 together to form a join or joint in the form of a transition zone 25 between the steel rope section 17*a* and the polymeric filler section 17*b*.

In FIG. 8, the central rope 22 shown in FIG. 6 is inserted into the hole 23 shown in FIG. 7, and preferably glued thereinto. A number of polymeric rods 26 are then located between the end of the polymeric section 17*b* and the end of each of the remaining steel ropes 21 so as to fill the space therebetween, and provide a constant outer diameter between the steel rope section 17*a* and the polymeric filler section 17*b*. A suitable tape 24 is then wound around the parts of the join.

The type of join or joint shown in FIG. 8 can also be termed a 'spliced' join, and is capable of being created during manufacture of the longitudinal strength members.

FIGS. 9*a*-9*g* show steps in a second method of providing a longitudinal strength member having a varying characteristic such as tensile strength along its length, and preferably having a constant outer diameter between two sections comprising different materials.

Figure 9A:
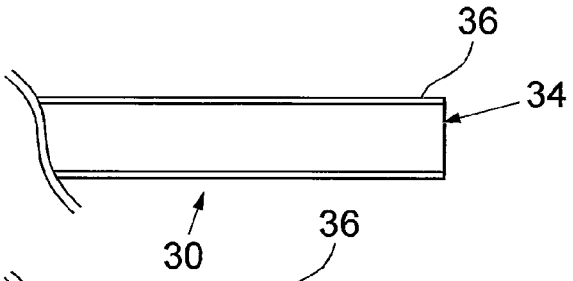
FIGS. 9*a*-9*g* are seven cross-sectional drawings showing steps in a process for forming a transition zone between a steel rod and a polyethylene rod.
Figure 9B:
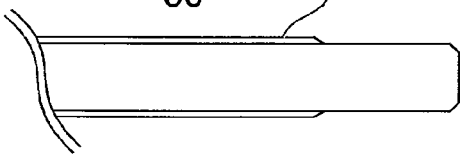
Figure 9C:
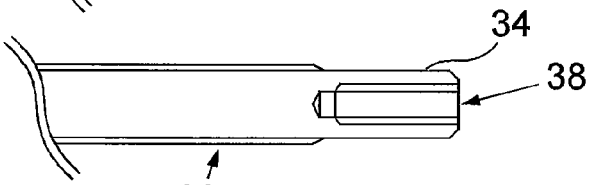
Figure 9D:
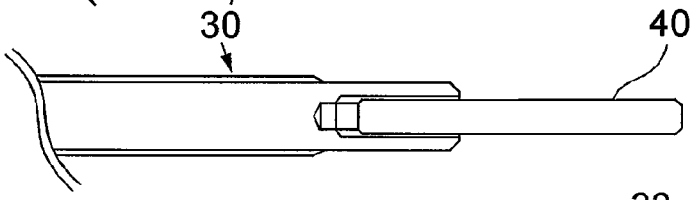

FIGS. 9*a*-9*g* show steps in the process of forming a transition zone between the end of a steel rod section 30, and a polyethylene rod section 32. Starting with a steel rod 34 with a polymer sheath 36 of the steel rod section 30 in FIG. 9*a*, FIG. 9*b* shows the cutting back of the sheath 36 and chamfering of the free edge of the steel rod 34. FIG. 9*c* shows the drilling of a hole 38 along the steel rod axis 34 from its free end to a predetermined depth, followed by tapping a thread thereinto. FIG. 9*d* shows the insertion of a screw-threaded bar 40 into the hole 38.

Figure 9E:
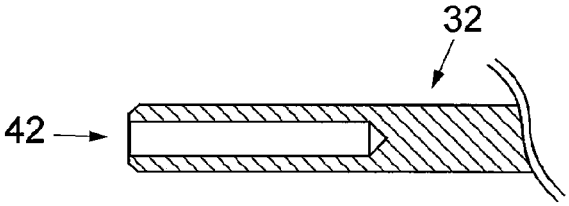
Figure 9F:
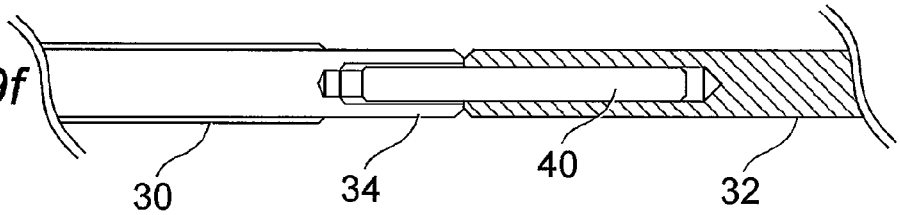

FIG. 9*e* shows the preparation of the free end of a polyethylene rod 32, comprising bevelling the edge of the end of the polyethylene rod 32 followed by drilling of a hole 42 from the free end of the rod 32 along the central axis. FIG. 9*f* shows the conjoining of the steel rod section 30 to the polyethylene rod section 32 by the insertion of the threaded bar 40 into the hole 42, preferably with the addition of adhesive and/or providing a push fit between said components.

Figure 9G:
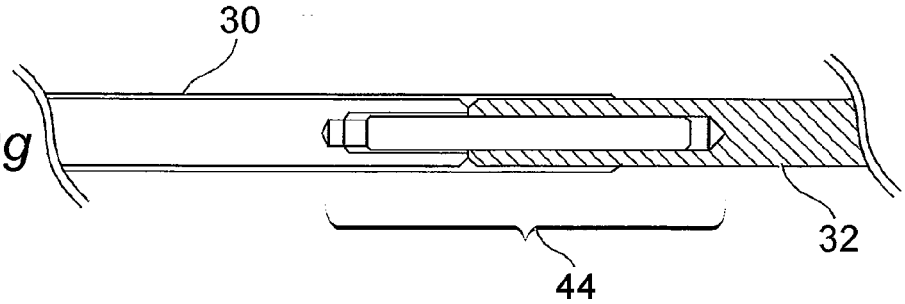

FIG. 9*g* then shows the addition of filler material and tape around the join area of transition zone 44 to complete the creation of a varying tensile strength longitudinal strength member, preferably having a constant outer diameter along its length. Such a longitudinal strength member could be used in the same arrangement in the umbilical 1 shown in FIGS. 2 and 3, with the steel rod section 30 replacing the steel rope section 17*a*.

Figure 10A:
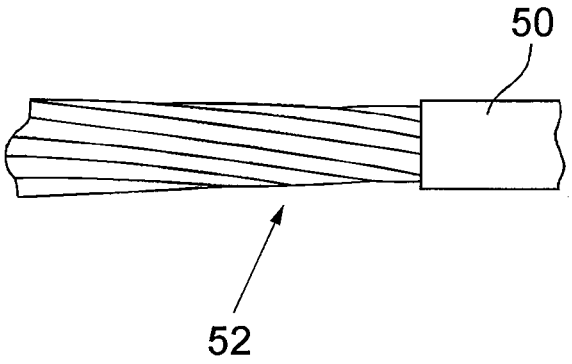
FIGS. 10*a* and 10*b* show plan views of a high strength fibre rope having its oversheath removed, followed by crimping with a steel rope.
Figure 10B:
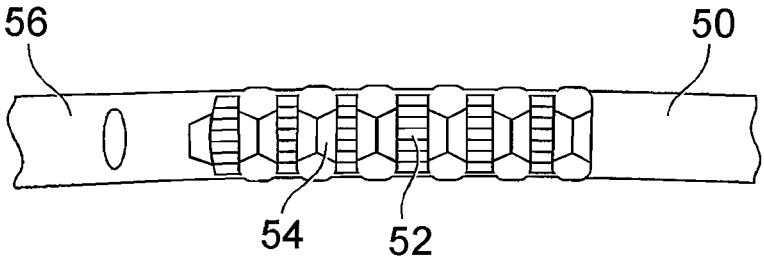

FIGS. 10*a*-10*b* show some steps in a third method of providing a longitudinal strength member having a varying characteristic tensile strength along its length, and preferably having a constant outer diameter between two sections comprising different materials. This method is based on the longitudinal strength member comprises a steel rope section and a high strength fibre rope section, the high strength fibre being made of any high modulus light weight organic material such as Zylon or Aramid (such as Kevlar, Technora).

This provides similar advantages to the steel rope and steel rod longitudinal strength members described above, in particular for providing sufficient strength for the near surface sections of umbilicals under dynamic conditions, and still having the high strength fibre section designed to withstand the required installation loads and static loadings. Such advantages include creating an umbilical having a much lower weight than that with non-varying steel rope strength members. This can provide umbilicals suitable for very significant depths, such as up to 4000 m, even with copper power cables therein.

The ends of steel ropes or steel rods can be joined to the ends of high strength fibre ropes by the removal of any over sheaths, and the use of crimping to effect a secure joining of the ends. Hex crimps and hydraulic crimping tools are known in the art, able to provide joint strengths of >20 kN and even up to and beyond 50 kN.

FIGS. 10*a* and 10*b* show the end of a high strength fibre rope 50, with its oversheath 52 removed over a certain distance in FIG. 10*a*. FIG. 10*b* shows a crimp 54 already conjoined with the end of a steel rope section 56, which crimp 54 is located around the un-sheathed end of the high strength fibre rope 50, followed by crimping by a crimping machine in a manner known in the art to form a secure joint thereinbetween.

Further particular examples of other longitudinal strength members according to the present invention include longitudinal strength members comprising at least a polymer filler section and a high strength fibre rope section or a composite rod (such as a carbon/epoxy) section. These examples avoid using steel ropes or steel rods to reduce and/or minimise the weight of the umbilical through the use of lighter weight strength sections. They also still provide suitable axial strength and depending properties to allow installation and withstand static loads, in particular for continuous passage through a helix machine.

Additional light weight strength members could also be added into locations where additional strength is desired, such as the section D1 shown in FIG. 1. Such examples provide longitudinal strength members to create very light umbilicals.

Joins between the different tensile strength sections of such examples can be provided using crimping methods especially as they can be easily loaded into helix machines bobbins. Alternatively, such light weight sections could be conjoined by splicing during helical lay operations, whereby the ends of the two different sections are located on separate bobbins which are swapped at the transition point so that the transition splices are made as close to the bundle as possible.

Intermediate steel crimps or crimp sleeves around such joins could be added.

In a further example of a longitudinal strength member for use in the present invention, high strength sections are located in the umbilical in the section D1 of FIG. 1 to meet the local high tension and bending stress requirements as described hereinabove. However, such high strength sections are stopped at the end of section D1, and non-conjoined filler sections are then located in the expected continuing pathways of the high strength sections, so as to maintain a constant outer diameter of the umbilical whilst avoiding forming of join or joints. In this way, there are provided sharp or discreet transition zones.

Alternatively and/or in addition, there can be created non-contacting transition zones between sections of a longitudinal strength member, which could extend a predetermined existence so as to create gaps therebetween. Such umbilicals are still sufficiently rigid enough to resist compressive loads, whilst reducing weight. Such arrangements are easily implemented on umbilicals having armouring layers of wires wound around the umbilical, generally just under the external sheath.

The present invention provides an umbilical having an evolving or changing cross-sectional property along its length, to provide evolving or changing mechanical properties along its length, such as being an evolving or changing tensile strength. In particular, it can provide reinforcement in the umbilical in the upper area or topside area (such as section D1 shown in FIG. 1), by including additional strength members in this area only, which increases the overall strength and fatigue life of the umbilical, without increasing the weight and cost of the remaining length of the umbilical.

Such umbilicals can also still be formed with conventional design and manufacture machinery and techniques, preferably by maintaining a constant outer diameter along the length of the umbilical, and preferably by the or each longitudinal strength member in the umbilical also having a constant outer diameter so as to maintain ease of its forming with the other elements of the umbilical in a manner known in the art.

The present invention applies to any type or form of umbilical for use in the offshore production of hydrocarbons, and is not limited to power umbilicals. This can include for example steel tube umbilicals. Such umbilicals may comprise one or more of the group comprising: electrical cables, optical fibre cables, steel tubes and hoses, optionally in any combination.

Various modifications and variations to the described embodiments of the invention will be apparent to those skilled in the art without departing from the scope of the invention as defined in the appended claims. Although the invention has been described in connection with specific preferred embodiments, it should be understood that the invention as claimed should not be unduly limited to such specific embodiments.

What is claimed is:

1. An umbilical configured for use in the offshore production of hydrocarbons comprising electrical cables and a plurality of longitudinal strength members, said strength members having one or more varying characteristics along the length of the umbilical, said umbilical having one end with a higher tensile strength than its other end, said strength members comprising a plurality of different sections of different characteristic(s), said sections comprising at least two of the group comprising: steel rope, steel rod, polymeric filler, high strength fibre rope, and composite rod, said longitudinal strength members each comprising a polymer filler section and at least one other section selected from the group consisting of: steel rope, steel rod, high strength fibre rope and composite rod, said umbilical having a wholly or substantially constant outer diameter along its length, wherein each of the longitudinal strength members and/or their combination comprises a wholly or substantially constant outer diameter along its or their length.

2. The umbilical as claimed in claim 1 wherein each strength member is wound helically or in a S/Z pattern along the umbilical.

3. The umbilical as claimed in claim 2 wherein each strength member has a constant helical or S/Z pattern winding along the umbilical.

4. The umbilical as claimed in claim 1 comprising sequentially at least a first section having a first characteristic(s) extending from one end of the umbilical, a transition zone, and a second section having a second and different characteristic(s) to the first section.

5. The umbilical as claimed in claim 4 wherein the or each transition zone comprises a join or joint between the sections of the strength member on either side of the transition zone.

6. The umbilical as claimed in claim 1 configured for use at a depth of greater than 2000 m.

7. The umbilical as claimed claim 1 further comprising one or more non-varying longitudinal strength members.

8. The umbilical as claimed in claim 1 wherein at least one strength member comprises a steel rope section and a composite rod section.

9. The umbilical as claimed in claim 1 wherein at least one strength member comprises a steel rope section and a high strength fibre rope section.

10. The umbilical as claimed in claim 1 wherein the characteristic(s) which vary along the length of the longitudinal strength members include one or more from the group comprising: tensile strength, specific gravity, strength to weight ratio, fatigue resistance, flexibility, temperature resistance, corrosion resistance, yield strength, Young's modulus, axial stiffness, and stress.

11. The umbilical as claimed in claim 10 wherein the characteristic which varies along the length of the longitudinal strength members is tensile strength.

12. The umbilical as claimed in claim 4, wherein the second section extends to the other end of the umbilical.

13. The umbilical as claimed in claim 5, wherein the join or the joint provides a longitudinal strength member having a continuous length being wholly or substantially the length of the umbilical.

14. The umbilical as claimed in claim 1 configured for use at a depth of greater than 3000 m.

15. A method of manufacturing an umbilical configured for use in the offshore production of hydrocarbons comprising electrical cables and a plurality of longitudinal strength members having one or more varying characteristics along their length, the method comprising at least the step of forming a number of longitudinal strength members as part of the umbilical, said umbilical having one end with a higher tensile strength than its other end, said strength members comprising a plurality of different sections of different characteristic(s), said sections comprising at least two of the group comprising: steel rope, steel rod, polymeric filler, high strength fibre rope, composite rod and composite rope, said longitudinal strength members each comprising a polymer filler section and at least one other section selected from the group consisting of: steel rope, steel rod, high strength fibre rope and composite rod, said umbilical having a wholly or substantially constant outer diameter along its length, wherein each of the longitudinal strength members and/or their combination comprises a wholly or substantially constant outer diameter along its or their length.

16. The method as claimed in claim 15 wherein the longitudinal strength members are formed in a helical or S/Z pattern.

17. The method as claimed in claim 16 wherein the longitudinal strength members are formed in a constant helical or S/Z pattern.

* * * * *